United States Patent [19]

Sargis et al.

[11] 4,269,401

[45] May 26, 1981

[54] METHOD AND APPARATUS FOR COLLATING AND STACKING DOCUMENTS AND FOR EFFECTING A HIGH DENSITY STACK IN A DOCUMENT RECEIVING BIN

[76] Inventors: John R. Sargis, Chicago, Ill.; AES Technology Systems, Inc., 02, Elk Grove Village, Ill.

[21] Appl. No.: 965,884

[22] Filed: Dec. 4, 1978

[51] Int. Cl.[3] ..... B65H 39/06; B65H 31/02

[52] U.S. Cl. ..... 270/58; 271/184; 271/188; 271/207; 271/299; 271/306

[58] Field of Search ..... 270/58; 271/184, 225, 271/279, 299, 188, 207, 213, 223, 224, 84, 269, 233, 271, 278, 306, 218, 189; 414/41, 42, 89, 900

[56] References Cited

U.S. PATENT DOCUMENTS

| | | | |
|---|---|---|---|
| 2,089,890 | 8/1937 | Graf et al. | 271/213 |
| 2,101,328 | 12/1937 | Broadmeyer | 271/188 |
| 2,547,964 | 4/1951 | Nordquist et al. | 271/233 |
| 2,631,039 | 3/1953 | Barber | 271/207 |
| 2,879,991 | 3/1959 | Pitner | 271/225 X |
| 3,044,772 | 7/1962 | Trenner | 271/184 |
| 3,178,170 | 4/1965 | Walck et al. | 270/58 |
| 3,655,180 | 4/1972 | Holler | 270/58 |

FOREIGN PATENT DOCUMENTS

| | | | |
|---|---|---|---|
| 2125196 | 11/1972 | Fed. Rep. of Germany | 271/188 |

*Primary Examiner*—Bruce H. Stoner, Jr.
*Attorney, Agent, or Firm*—Dressler, Goldsmith, Shore, Sutker & Milnamow, Ltd.

[57] ABSTRACT

A method and apparatus are provided for transporting documents in first and second adjacent parallel transport paths in aligned rows of two documents transverse to the paths and for arranging the documents into a single stack of documents wherein the two adjacent documents of each row in the transport paths are stacked one on top of another so that the document from the first path is below the adjacent document from the second path.

2 Claims, 17 Drawing Figures

30
34
36
37
40
32
38

56
66
54
72
A
50
68
50
70
58
70
50
70
52
70
50

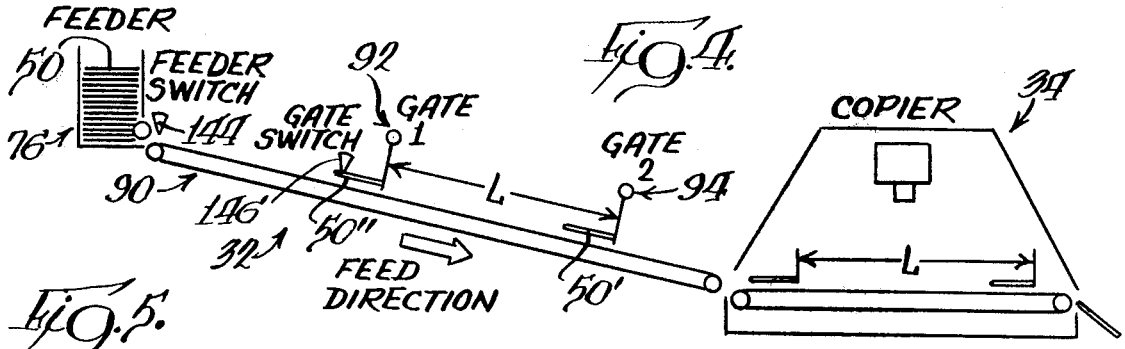
Fig. 4.
Fig. 5.
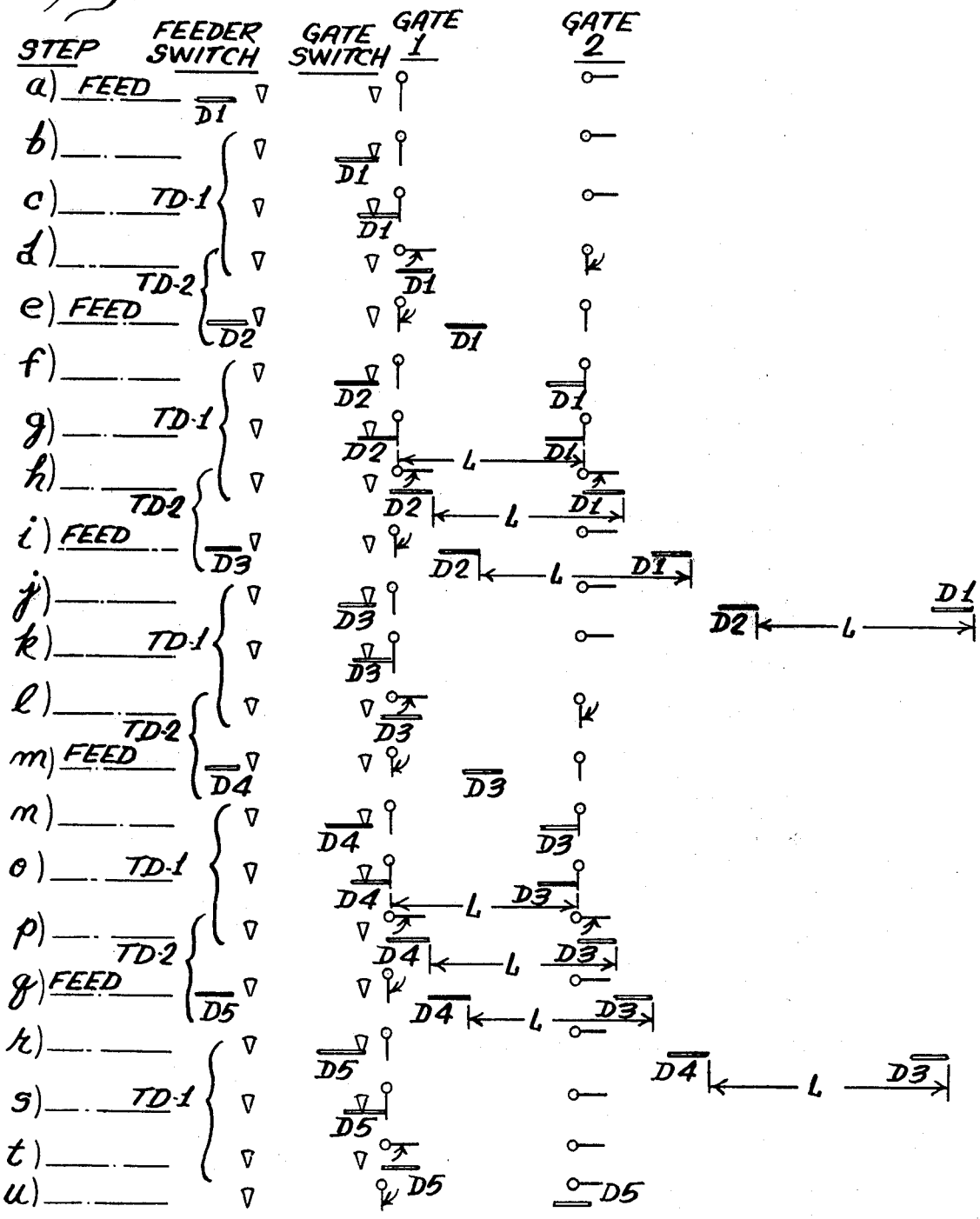

212
210
150
164'
180'
168'
154
160'
176'
156
160
158
180
7.
7.
152
176
168
164
162
182
186
183
181
184
170
188
194
192
190
196
100

152
180
168
8.
8.
162
164
178

50"
178
158
176
178
180
160
152
164
162
168
198
198

282
276
274
290
288
284
297
70
298
296
12.
295
36
286
12.
272
270
278

36
270
298
296
274
290
292
284
288
286
280

METHOD AND APPARATUS FOR COLLATING AND STACKING DOCUMENTS AND FOR EFFECTING A HIGH DENSITY STACK IN A DOCUMENT RECEIVING BIN

CROSS-REFERENCE TO RELATED APPLICATIONS

This application is related to the following three applications filed concurrently herewith:

(1) "Method and Apparatus for Transporting Documents With Preselected Interdocument Spacing", Ser. No. 965,886;

(2) "Double Document Detector", Ser. No. 965,885, now abandoned; and (3) "Method and Apparatus for Sensing Paper Length", Ser. No. 965,883, now abandoned.

BACKGROUND OF THE INVENTION

The present invention relates to document copying mechanisms, and to document handling mechanisms associated with document copying mechanisms, such as document feeding and copy document stacking mechanisms. More particularly, the present invention is specifically related to an apparatus comprised of a plurality of mechanisms or subassemblies for feeding and copying groups of two or more documents from a stack of documents and for sorting and stacking the resulting copies.

Use of automatic feeding and copying devices has been known for many years. Typically, documents of letter size, 8½ by 11 inches, or legal size, 8½ by 13 inches, are most frequently copied and copying machines have been developed to specifically handle documents of this size. In many situations, however, documents of a smaller size must be processed. One such type of document is the bank check which is approximately 2¾ by 6 inches. Banks, and those businesses performing services for banks, frequently desire to make photocopies of checks that are processed by the bank. Since checks are considerably smaller than the 8½ by 11 format for which most copiers are designed, use of such copiers to make photocopies of checks is inefficient and/or wasteful.

It would be desirable to provide a method and apparatus for producing photocopies of small documents, such as checks, in an efficient and non-wasteful manner. Preferably, it would be desirable to provide a method and apparatus for making a photocopy of two or more checks in a single photographic exposure to reduce the number of photographic operations required to handle a large number of such small documents.

Further, it would be beneficial to provide means for producing photocopies of small documents on a plurality of parallel, continuous strips of paper and providing a method and apparatus for severing the strips of paper rapidly, yet accurately.

It would be advantageous if, when handling photocopies produced on two or more parallel strips of paper, the individual severed photocopies from all of the strips could be received and assembled in a single stack—rapidly, automatically, and in a consistent sequentai order.

When feeding documents into a copier, it would also be helpful to provide a method and apparatus for detecting the presence of two or more overlapped documents before they entered the copy machine. In particular, it would be desirable to provide a means of automatically detecting such overlapping documents and shutting down the operation without any further processing of the overlapping documents. It would also be advantageous to provide a method and automatic apparatus for quickly and efficiently separating the overlapping documents and permitting them to be again fed one at a time into the copier.

SUMMARY OF THE INVENTION

The present invention includes a novel method and apparatus for processing documents, especially as part of, or in conjunction with, a copier machine. The method and apparatus of the present invention are particularly well suited for use with a copier machine adapted for photocopying small documents, such as checks having a size of about 2¾ by 6 inches.

In particular, a method and apparatus are provided for transporting documents in first and second adjacent parallel transport paths in aligned rows of two documents transverse to the paths and for arranging the documents into a single stack of documents wherein the two adjacent documents of each row in the transport paths are stacked one on top of another so that the document from the first path is below the adjacent document from the second path. Both documents from a row are directed along separate discharge paths to a discharge region above a receiving bin with one document discharge path below the other so that both documents fall into the receiving bin to form a vertical stack.

In one embodiment of the apparatus two inclined slides are provided with each slide having an upper inlet end at the elevation of the transport paths for receiving documents from its respective transport path. The other end of each slide is located at an elevation below the inlet end but with one of the slides having the discharge end below that of the other slide.

In a second embodiment, documents from the first transport path are discharged directly into a receiving bin and free fall to the bottom thereof. Documents from the second transport path are discharged to a document holding platform adjacent and above the receiving bin and then are pushed laterally off of the platform into the receiving bin and on top of the document from the first discharge path to form a stack.

A motor-vibrator can be secured to the underside of the bin for vibrating the bin whereby documents within the bin that lie at an angle with respect to the bottom and in contact with the surrounding bin wall are caused to vibrate and slide into an orientation on top of the bin bottom so they are aligned generally parallel to the bin bottom to form a relatively dense stack of documents.

The combined effect of the various elements associated in accordance with the present invention is greater than the sum of the several effects of those elements taken separately. The novel combination of elements in accordance with the present invention yields desirable, beneficial and synergistic results—results which, though unusual and surprising, are also a substantial improvement over the prior art.

Numerous other advantages and features of the present invention will become rapidly apparent from the following detailed description of the invention and embodiments thereof, from the claims and from the accompanying drawings.

BRIEF DESCRIPTION OF THE SEVERAL VIEWS OF THE DRAWINGS

In the accompanying drawings forming part of the specification, and in which like numerals are employed to designate like parts throughout the same.

FIG. 4 is a schematic illustration of the method of feeding groups of two documents along a path from a stack of documents and into a copier subassembly so that the documents in each group of two are spaced apart at a selected distance from each other;

FIG. 5 is a diagrammatic chart illustrating the steps, steps a through t, of the method of feeding groups of two documents along a path as schematically illustrated in FIG. 4;

DETAILED DESCRIPTION

Figure 1:
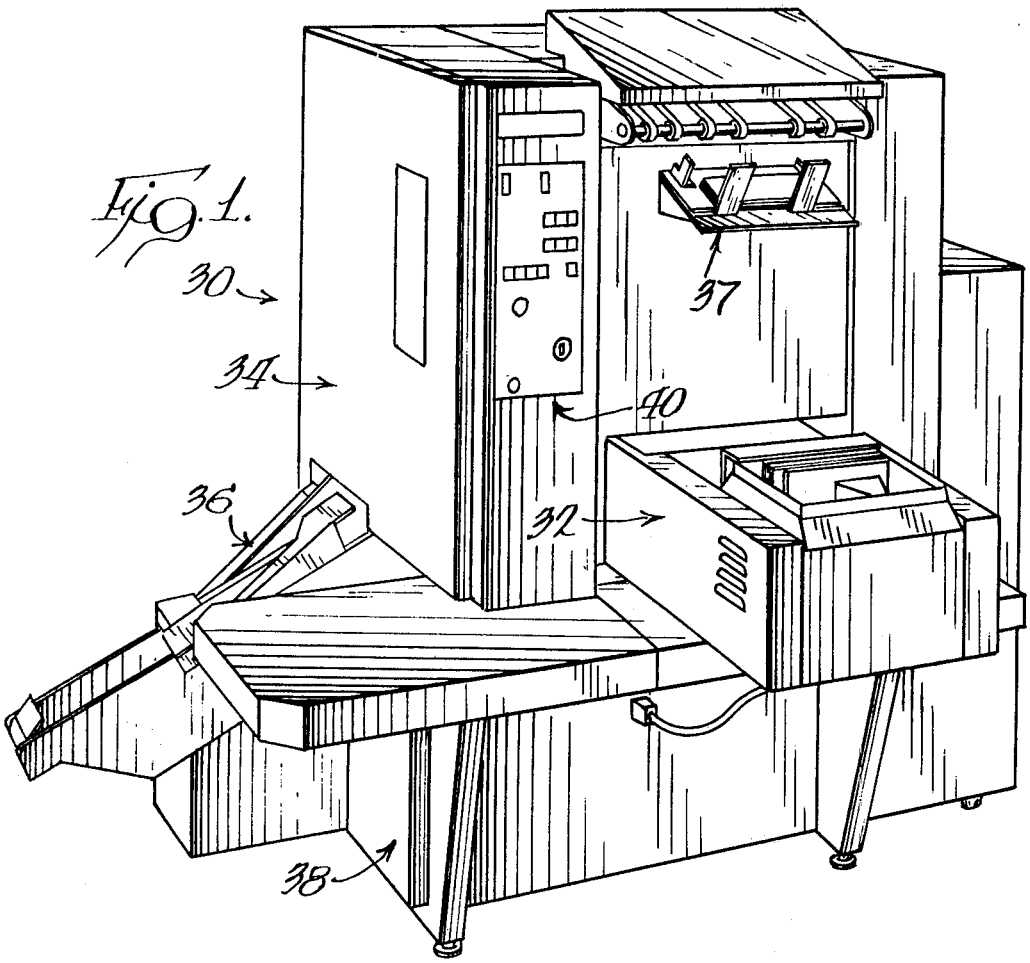
FIG. 1 is a perspective view of the apparatus incorporating the features of the present invention.

While this invention is susceptible of embodiment in many different forms, there are shown in the drawings and will herein be described in detail preferred embodiments of the invention. It should be understood, however, that the present disclosure is to be considered as an exemplification of the principles of the invention and is not intended to limit the invention to the embodiments illustrated and/or described.

The precise shapes and sizes of the components herein described are not essential to the invention unless otherwise indicated, since the invention is described with only reference to an embodiment which is simple and straightforward.

For ease of description, the apparatus will be described in a normal operation position, and terms such as upper, lower, horizontal, etc., will be used with reference to this normal operating position. It will be understood, however, that this apparatus may be manufactured, stored, transported and sold in an orientation other than the normal operation position described.

Much of the apparatus disclosed herein has certain conventional drive mechanisms and control mechanisms the details of which, though not fully illustrated or described, will be apparent to those having skill in the art and an understanding of the necessary functions of such drive mechanisms.

FIG. 1 of the drawings generally shows the external appearance of a copier apparatus 30. The copier has three main portions or subassemblies: the original document feeder subassembly 32, the copier subassembly 34 and the copy document collator/stacker subassembly 36. The apparatus 30 may have a base 38 which, if desired, could be adapted to serve as a cabinet for storing materials related to the use of the apparatus 30. Typically, an exterior control panel 40 is provided on a convenient exterior portion of the copier 34.

Original documents are fed from an input stack sequentially, one at a time, and are arranged in groups of two or more, by means of feeder 32 into the copier 34. In the copier 34, microfilm copies and/or photocopies of the groups of documents are produced. The photocopy documents discharge from the copier 34 through the collator/stacker subassembly 36 wherein the copy documents are arranged in a single pile in a chronological sequence corresponding to the sequence in which the original documents were fed through the copier 34.

The original documents exit from the interior of the copier 34 and form a stack of documents, having the same order as the input stack, supported in a tray assembly 37.

In the following detailed description, the novel method of copying documents in the copier 34 will first be described. Then a detailed description of the method and feed apparatus 32 for feeding the documents into the copier will be presented. The method and apparatus for severing the individual copy documents from long strips of copy paper and for arraging them in a sorter pile in the collator/stacker subassembly 34 will be described last.

Copier

Figure 2:
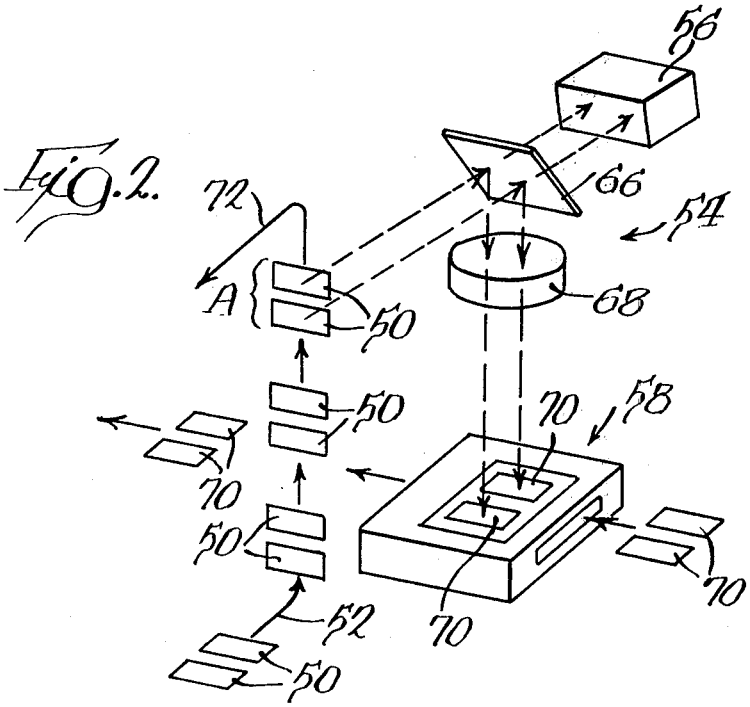
FIG. 2 is a diagrammatic view of the operation of the copy portion or copier subassembly of the apparatus.

Documents to be copied are fed by the feeder subassembly 32 of the apparatus 30 into the copier subassembly 34 for being copied on paper and/or microfilm. The copying process is schematically illustrated in FIG. 2 wherein documents 50, such as checks, which are to be copied are transported along a copier original document feed path in the direction of path arrows 52. The copier 34 includes image transmitting optical apparatus 54, the microfilming apparatus 56, and the paper copy chemical processor apparatus 58 which are well known and are described in detail in the U.S. Pat. No. 3,728,020 and reference is directed thereto. The copier document feed path 52, as well as these other components which are schematically illustrated in FIG. 2, are located within the copier subassembly 34 in FIG. 1.

In order to better understand the novel method of feeding groups of documents through copier subassembly 34, and in order to better understand the relationship between the copier subassembly 34 and the other features of the present invention, which include copy length sensor apparatus, the collator/stacker subassembly, the feeder subassembly, and double document detector apparatus, a brief description of the copier subassembly 34 will first be given.

A novel method is provided to transport documents 50, such as checks, along the path 52 in groups of documents, such as in groups of two, wherein each of the documents of a group are spaced a predetermined distance apart. Copies of the documents, either paper copies or microfilm, are made of all of the documents in each group by a single exposure process.

Specifically, as illustrated in FIG. 2, a pair of documents 50 is transported to a document exposure position designated by bracket A where the pair of documents is in proper orientation and registration for copying. The image of the pair of documents 50 is projected through transparent mirror 66 to the lens of a microfilm camera which is part of the microfilm apparatus 56 and is also reflected by mirror 66 through a lens 68 to sheets of copy paper 70 which is then transported through the chemical processor apparatus 58.

Preferably, copies of the documents 50 are made as reduced size reproductions on the copy paper 70. The copy paper 70 may be separately fed individual sheets of paper as illustrated or may be part of a continuous roll of copy paper which is subsequently severed after each exposure. Preferably, when copying a pair of documents in a single exposure, the copy paper 70 runs in two separate parallel paths as illustrated, either as separate sheets or as separate strips of a continuous roll, so that the individual document of each pair of documents is copied on a separate sheet or strip.

The novel method described herein thus permits a group of documents to be copied by means of a single exposure of each group. This is especially useful when copying relatively small documents such as bank checks. With this method, it is also possible to produce a multiple of hard paper copies in the chemical processor apparatus 58 while producing only one microfilm copy. To this end, the microfilm apparatus 56 would be inactivated after the initial exposure so that the subsequent exposures of the pairs of documents to produce additional hard paper copies do not produce unneeded extra permanent microfilm record copies, one being sufficient.

After the hard paper copy 70 is produced, the pair of original documents 50 is discharged from the copier, being transported along an original document discharge path 72, and the next succeeding pair of documents 50 is transported along the original document feed path 52 into position for exposure and for production of the desired number of hard paper copies 70 and of the desired record microfilm copy.

Though the above-described method includes the novel step of copying original documents in groups of two or more in a single exposure, the documents, once they are arranged in the groups with the required inter-document spacing within each group, can be transported through the copier 34 by well known conventional means, such as the document feed system illustrated and described in the above-referenced U.S. Pat. No. 3,728,020 and designated an element 56 therein, or by any other suitable positive document feeding apparatus.

Further, the method of producing copies, microfilm and/or hard paper copies, from original documents transported along a path in groups of two or more can be effected by any suitable means in addition to that illustrated in FIG. 2 which is described above. For example, a double mirror system could be used such as that more particularly set forth in the above-referenced U.S. Pat. No. 3,728,020.

Feeder

Figure 3:
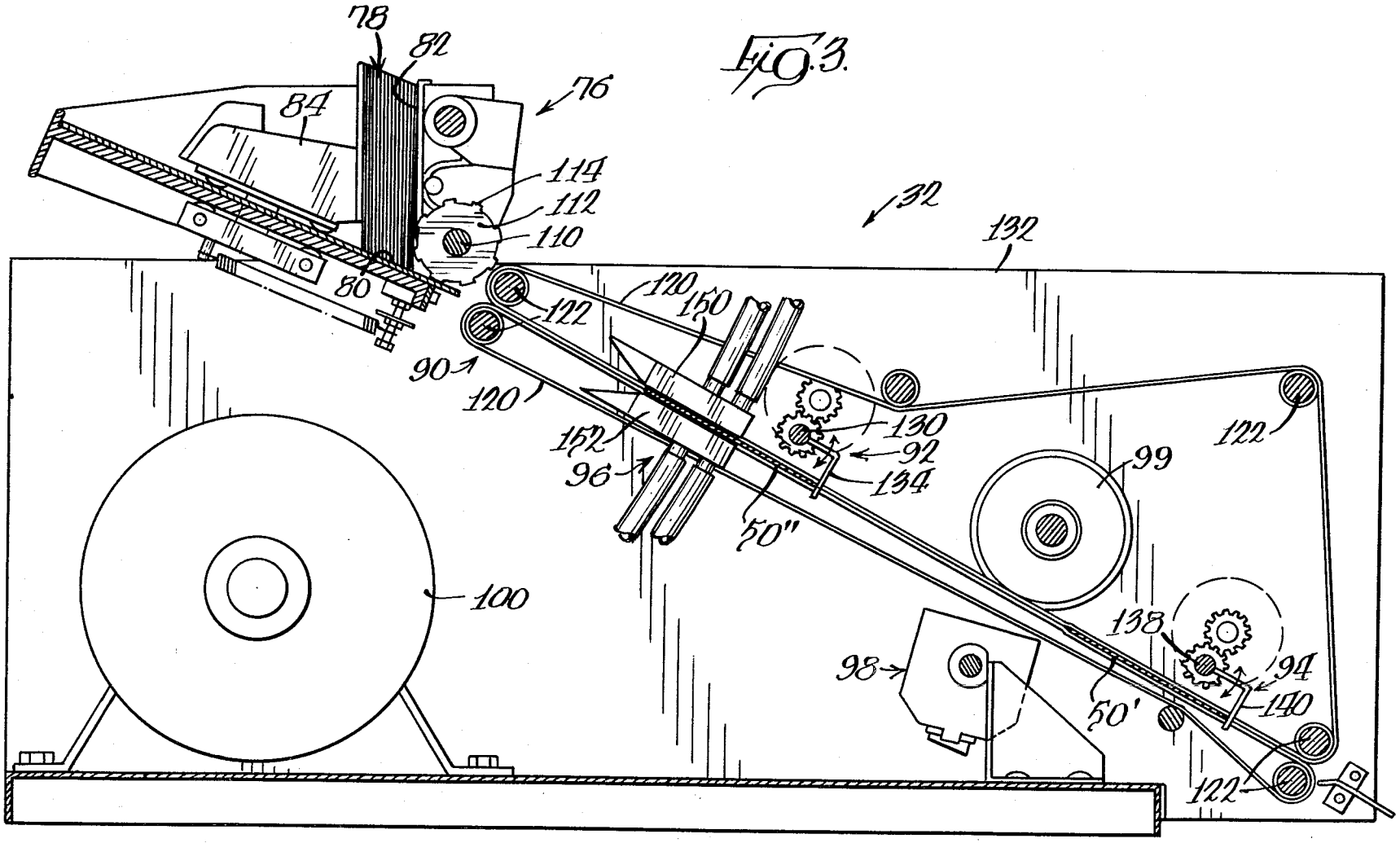
FIG. 3 is a side elevational view, partly in section, showing the various components of the document feeding portion or subassembly of the apparatus.

The original document feeder subassembly 32, illustrated in FIG. 1 as being connected with the copier subassembly 34 for feeding original documents thereto, is illustrated in greater detail in the side elevational cross-sectional view of FIG. 3. The feeder subassembly 32 includes a number of major mechanisms which will each be explained a detail below. These major mechanisms include an original document stack feeding mechanism 76, endless belt means 90, first gate means 92, second gate means 94, double document detecting means 96, printing means 98, including a cooperating printing impression roller 99, and drive motor 100.

The stack feeding means 76 is selectively actuated to sequentially feed documents from a source 78 located adjacent one end of the feeder subassembly 32. The document source 78 consists of an inclined trough 80 having a vertical forward wall 82 with follower means 84 guided for movement along trough 80 to apply pressure to the trailing end of a stack of documents that are positioned to have opposed surfaces generally parallel to vertical wall 82.

The original document stack feeder 76 consists of a shaft 110 rotatably supported on the sidewalls of trough 80 with a resilient rubber roller 112 secured to the shaft. Resilient roller 112 has circumferentially spaced axial extending projections 114 that define gripping means or a gripping surface for a document. Such a feeder is well known in the art and is described in detail in U.S. Pat. No. 4,015,523 and reference is directed thereto.

The original documents are fed from the stack feeder 76 to the endless belt means 90 which defines the path for the documents that are fed from the stack or source 78 to the copier subassembly 34. The endless belt means 90 is of the type well known in the art and consists of a plurality of narrow endless belt strips 120 that are entrained over shafts 122, which structure is described in the above-referenced U.S. Pat. No. 4,015,523 with respect to the belt strips 50 described therein and illustrated in FIG. 6 thereof and also with respect to the belt strips 22 described therein and illustrated in FIGS. 9 and 10 thereof.

The belt means 90 is driven by drive motor 100 through conventional drive transmission means such as those described and illustrated in the above-referenced U.S. Pat. No. 4,015,523.

A novel assembly of gate means, including first gate means 92 and second gate means 94, is provided to cooperate with the endless belt means for transporting and aligning pairs of documents sequentially along the path of the endless belt means 90 from the document stack or source 78 to a downstream receiver, such as copier subassembly 34, so that two documents are presented to the receiver as a pair of documents spaced apart at a predetermined distance. Each gate means 92 and 94 is located in the path of the moving documents.

First gate means 92 has a shaft 130 that is supported on opposite sidewalls of the casing 132 of the feeder subassembly 32 for rotation about its axis. Shaft 130 has a plurality of fingers 134 extending therefrom which are fixedly secured to the shaft by suitable means (not shown). The fingers 134 are positioned on the shaft 130 so as to be in alignment with the spaces between the adjacent edges of the respective belt strips 120 so that the free end of the fingers 134 extend below the path defined by the opposing surfaces of the belts 120. Shaft 130 is periodically rotated by suitable drive means, such as a conventional rotary solenoid and gear drive system.

Alternatively, a suitable drive means is that described and illustrated in the above-referenced U.S. Pat. No. 4,015,523 for the gate means 24 shown in FIGS. 2 and 6 thereof.

Second gate means 94 has a construction identical to that of the first gate means 92. Specifically, second gate means 94 includes a shaft 138 with fingers 140 projecting into the document path. The second gate means 94 is also moved, as by periodic rotation of shaft 138, by suitable drive means such as that described above for the first gate means 92.

The fingers 134 and 140 of the first and second gate means, respectively, define first and second document stop positions, respectively, in the path of the movement of the documents so that the continuously moving belts 120 will drive the leading edges of the documents into engagement with the fingers and ensure that the leading edges are transverse or normal to the path for a purpose that will be described later. Documents 50'' and 50' are shown stopped by first gate means 92 and second gate means 94, respectively. The two documents 50' and 50'' comprise a pair of documents and the leading edges of the two documents are necessarily spaced apart by a predetermined distance which is equal to the distance between the fingers 134 of the first gate means and the fingers 140 of the second gate means 94.

The method of operating the feeder subassembly 32, and specifically the gate means 92 and 94, to transport and align pairs of documents sequentially along the path at a predetermined spaced apart distance will now be described with reference to the diagrammatic illustration of FIG. 4 and the diagrammatic chart of FIG. 5.

In FIG. 4, the original document stack feeder 76 is diagrammatically illustrated as feeding documents 50 onto the belt means 90 past first gate means 92 and second gate means 94 to copier subassembly 34.

A document feed sensing means or feeder switch 144 is provided adjacent the stack feeder 76 for sensing the feeding of a document to the document path defined by the endless belt means 90. A document advancement sensing means or first gate switch 146 is provided adjacent and upstream of the first gate means 92 for sensing advancement of a document 50 along the path to a position at or slightly upstream of the first gate means 92.

One of the objectives of the method of feeding documents is to feed the documents so that, ultimately, the documents are arranged in a transport path in groups, for example, pairs, wherein the individual documents in each group are spaced apart at a selected or predetermined distance. Then, the groups of documents can be fed into other apparatus, such as the copier subassembly 34, for copying in one exposure in a predetermined format. This objective is efficiently accomplished by operating the gate means and document feeder in cooperation with the continuously moving belt means. The method, as applied to feeding documents in pairs, will now be explained in detail with reference to the diagrammatic chart illustrated in FIG. 5.

Preferably the copier subassembly is initially energized to orient the second gate means 94 in a raised or open position with the first gate means 92 in a lowered or closed position. Then, as illustrated in Step a of FIG. 5, the stack feeder 76 is actuated to feed a first document D1 onto the document moving means, such as the continuously driven endless belt means 90.

Next, as illustrated in Step b, the first document D1 is transported along the path defined by the endless belt means 90 past the document feed sensing switch 144 and towards the document advancement sensing switch 146. The feeder switch 144 includes means for sensing the passage of a document and for producing a signal as a function of the first document of a pair moving past the switch 144. The switch 144 may be of any suitable type, such as a mechanically activated microswitch or a photocell type. In any case, control means are also provided which are responsive to the signal from the switch 144 for momentarily terminating the feeding of the documents from the original document stack feeder 76 after the first document has been fed as sensed by the switch 144.

As illustrated in Steps b and c, the first document D1 moves past document advancement sensing means switch or gate switch 146, until the leading edge of document D1 abuts the first gate means 92, also labeled gate 1, which is oriented in a closed positon to engage the leading edge of the document D1 so as to interrupt the movement of the document D1 along the path at a first stopped position and to position and leading edge of the document D1 normal to the path.

As the first document D1 passes the gate switch 146, the switch, which includes a sensing means for sensing advancement of the document therepast, is actuated. Gate switch 146 includes means for producing a signal as a function of the sensing of a document moving past it. Control and actuation means, responsive to the signal produced by the actuation of gate switch 146, are also provided to move the first gate means away from the transport path to an open position at the end of a first time period so as to permit the first document D1 to continue moving along the path. As in the case with the document advancement sensing means or feeder switch 144, the gate switch 146 may be of any suitable type, including a mechanically actuated microswitch or a photocell type.

The actuation means for moving the first gate from the closed to the open position could include a rotary or linear electric solenoid or other suitable device and the control means associated with the switches 144 and 146 can include appropriate timers or time delay devices, which may be operated mechanically, electrically, or electronically. Such moving means and control means are well known in the art and no further description of the details of such systems or devices will be given herein.

Gate switch 146 actuates the opening of gate 1 only after a predetermined period of time to ensure that the document D1 has been transported up against the first gate and been aligned therewith normal to the transport path. After this first time delay, indicated by bracket TD-1 encompassing Steps b through d, gate 1 is opened (Step d) to allow document D1 to continue therepast in the path.

By suitable control means, gate 2 (also labeled gate means 94 in FIGS. 3 and 4) downstream of gate 1, is actuated to change positions whenever the first gate is opened. Specifically, if gate 2 is initially open, then when gate 1 opens, gate 2 will close. On the other hand, if gate 2 is initially closed, then when gate 1 opens, gate 2 will open. Since gate 2 is preferably initially open as illustrated in Step a of FIG. 5, when gate 1 is opened in Step d, gate 2 closes. Preferably, the closing of gate 2 occurs substantially simultaneously with the opening of gate 1 in Step d.

When gates 1 and 2 open, they remain open for a predetermined period of time. This is accomplished by any suitable means, such as conventional control circuits, responsive to the opening of gate 1, which then actuate a timing system to close the gate 1 after a second time delay indicated in Steps d and e by bracket TD-2. It is to be noted that when gate 1 is closed after the second time delay period, the first document D1 has been transported past gate 1. Further, it is to be noted that gate 2 remains in the closed position as indicated in Step e when gate 1 closes. This is because gate 2 is actuated to change position (either from closed to open or from open to closed) only upon the opening of gate 1.

At the end of the second time period TD-2, the stack feeder 76 is actuated by suitable control means, to again feed a second document D2 into the path as illustrated in Step e. The second document D2 moves past the document feed sensing means, or feeder switch 144, which produces a signal for momentarily terminating the feeding of the documents from the stack feeder 76.

As illustrated in Step e, two documents are now in the transport path: first document D1 and second document D2. As the documents are carried forward, document D2 approaches and actuates gate switch 146. Also, at this time, the first document D1 continues to the closed gate 2.

After an appropriate time delay TD-1 (Steps f through h) initiated by gate switch 146 to ensure that the second document D2 is properly abutting gate 1, gate 1 is opened and document D2 continues therepast. As gate 1 opens, gate 2 also opens since gate 2 is controlled to change position whenever gate 1 opens. As shown in step h, gate 1 opens for the second time at the end of the predetermined time period TD-1, which time period begins with the actuation of gate switch 146 in Step f.

It is to be noted that in Step g document D2 and document D1 are simultaneously abutting gates 1 and 2, respectively, so that their respective leading edges are necessarily maintained at a predetermined spaced apart distance equal to the spacing L between gate 1 and gate 2. In step h, when gates 1 and 2 open, documents D2 and D1 continue to be moved along the path by the conveyor means 90 at the predetermined spacing L. Thus, through the above-described steps comprising this portion of the method, a group of documents, specifically a pair of documents, has been formed with a predetermined spacing L between the documents of the group.

The predetermined spacing L between the documents of the pair is adjusted by varying the distance between gate 1 and gate 2. The actual spacing L between documents in a group is chosen to accommodate the particular requirements of the downstream processing apparatus. In the case illustrated, the documents are copied in a copier subassembly 34 which requires a certain predetermined spacing L as illustrated in FIG. 4. Thus, once the documents are arranged by the feeder subassembly 32 in the two-member groups with the appropriate spacing L, the documents proceed with that spacing from the feeder subassembly 32 to the copier subassembly 34.

It should be noted that the document feeding method could be started with gate 2 in the closed position along with gate 1 in Step a. However, in that case, the above-described gate actuation sequence would result in the first document D1 necessarily passing through the copier as a single member and not as part of a pair of documents. That is, in a two-gate system commencing operation with both gates in the closed position, the transporting of the first document D1 as a single document is unavoidable. However, this would happen only with the first document D1. The subsequent documents would be operated upon by the sequencing gates so as to form the desired pairs.

Continuing with the step-by-step illustration of FIG. 5, it is to be noted that the opening of gate 1 for the second time permits the passage of the second document D2 and initiates the time delay or timer system which closes gate 1 after the predetermined time period indicated for Steps h through i by bracket TD-2. Further, at the end of time period TD-2, the stack feeder is actuated to feed a third document D3 into the path as illustrated in Step i.

In Step j document D3 is shown as having passed the feeder switch 144 (to temporarily terminate the feeding of documents) and is shown passing the gate switch 146 to start a new timing cycle indicated by bracket TD-1 in Steps j through l. Gate 1 is maintained in the closed, or path-blocking, position until the end of the period TD-1 in order to ensure that the third document D3 is abutting gate 1 with the leading edge aligned normal to the path as shown in Step k. At the end of the time period TD-1, gate 1 is actuated to open as illustrated in Step l. Since gate 2 is actuated to change position whenever gate 1 is open, gate 2 necessarily closes as gate 1 opens in Step l.

It is seen that as gates 1 and 2 open in Step l, the time delay TD-2 is initiated and, upon termination of the time delay TD-2 in Step m, gate 1 is actuated to close to block the document feed path. Gate 2, being actuatable only in response to the opening of gate 1, remains closed as illustrated in Step m. Further, the closing of gate 1 initiates the feeder 76 to feed a fourth document D4 into the path as illustrated in Step m.

As document D4 is transported forward it actuates the feeder switch 144 to temporarily stop the feeding of documents from the feeder and then document D4 actuates the gate switch 146 in Step n which starts the timer system for opening the gate 1 after the time period TD-1 in Step p.

As illustrated in Step o, documents D4 and D3 abut the closed gates so that the predetermined distance L is established between the leading edges of the documents D4 and D3.

At the end of time period TD-1 in Step p, gate 1 opens to allow the passage of document D4 and, gate 2, being actuated to change position whenever gate 1 opens, necessarily opens also. The opening of gate 1 actuates the timing system to hold gate 1 open for the time period TD-2, after which period, gate 1 closes in Step q. The closing of gate 1 also actuates the feeding of a fifth document D5 into the path as illustrated in Step q. As illustrated in Steps p and q, documents D4 and D3 continue on and pass below open gate 2 and into the copier subassembly 34 as a pair of documents having a predetermined interdocument spacing L.

The document above-described feeding sequence is repeated, for example, by repeating Steps i through p, until all the documents have been fed or until the feeding is otherwise terminated.

It is possible to accommodate an odd number of stacked documents with the above-described method. Preferably, a "last document" switch, not illustrated, can be provided in the feeder 76 to be actuated when the last document has been fed from the feeder. For purposes of illustration, document D5 in FIG. 5 is assumed to be the last document in the stack which is fed from feeder 76. The last document switch in the feeder 76 is actuated in Step q of FIG. 5 upon the out-feeding of document D5. The switch overrides or steers the control system to keep gate 2 open (if it was open) or to open gate 2 (if it was closed) when gate 1 opens after the last document has been aligned against it. With reference to FIG. 5, gate 2 was already in the open position when the last document D5 was fed in Step q. In Step t, when gate 1 opens, gate 2 is prevented from closing (as it otherwise would be repeat the normal sequence) by the "last document" switch in the feeder 76. The last document D5 can thus pass, as shown in Step u, from the feeder subassembly 32 to the copier subassembly 34 as a single document without being unnecessarily stopped by gate 2.

It is possible to disable gate 2 in the open position to allow operation of the apparatus to process documents in a normal "single" mode with only gate 1 as in the prior art. Depending upon the specific design parameters the feed rate for documents processed with only one gate may drop to two-thirds of the two-gate "pair" rate.

Double Document Detector

A novel mechanism is provided for sensing the passage of two overlapping or partially overlapping documents along the endless belt means 90 in the feeder subassembly 32. A double document detecting means 96 is illustrated in FIG. 3 along the document feed path between the stack feeder 76 and the first gate means 92. The double document detecting means 96 is further illustrated in greater detail in FIGS. 6, 7, and 8.

Figure 7:
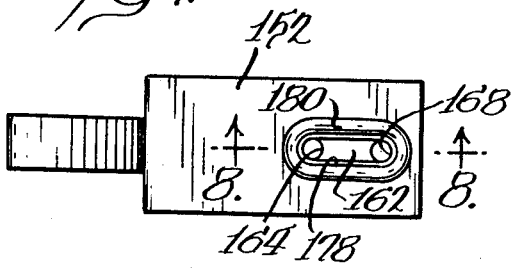
FIG. 7 is a plan view taken generally along the plane 7—7 in FIG. 6.
Figure 8:
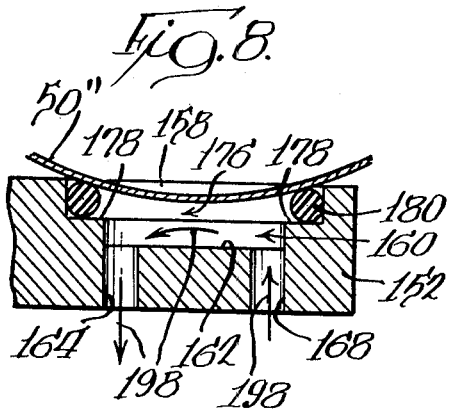
FIG. 8 is a cross-sectional view taken generally along the plane 8—8 in FIG. 7.

With reference to FIGS. 3, 7, and 8, it can be seen that the double document detecting means 96 comprises a pair of spaced apart, opposed blocks, such as upper block 150 and lower block 152. These blocks are arranged to allow the documents to pass along the path between them.

Figure 6:
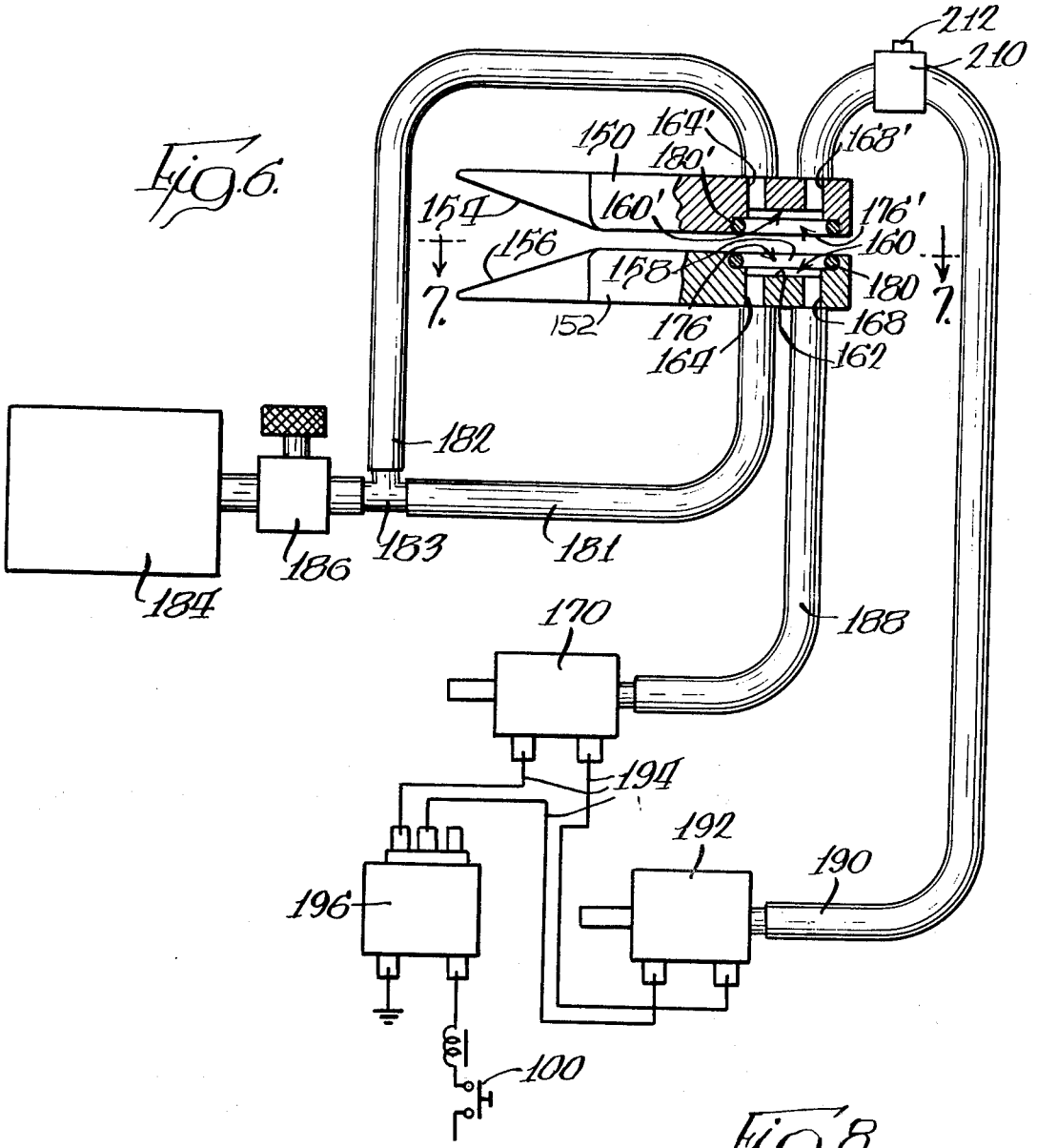
FIG. 6 is a diagrammatic view of the double document detector apparatus which forms part of the feeding portion of the apparatus.

As best illustrated in FIGS. 6, 7, and 8, the blocks 150 and 152 have front slanted faces 154 and 156, respectively, for receiving and guiding the documents between the blocks. The upper and lower blocks 150 and 152 have an identical, but oppositely oriented, configuration and internal structure. The structure will next be explained in detail for the lower block 152 with the understanding that the upper block 150 is identical.

With respect to FIGS. 6, 7, and 8, it can be seen that the lower block 152 has a concave wall means 158 defining a first chamber 160 which is open to the atmosphere in the path. The concave wall means 158 further has a bottom wall portion 162 spaced from the chamber opening. In the interior of the lower block 152 there is a first bore 164 communicating with the first chamber 160 through the bottom wall portion 162 and adapted to be connected to a means for drawing vacuum. A second bore 168 is provided in the interior of the block 152 for communicating with the first chamber 160 through the bottom wall portion 162 and is adapted to be connected to a vacuum switch 170 (FIG. 6).

Block 152 further defines a second chamber 176 communicating with the atmosphere in the document feed path and also with the first chamber 160. The second chamber 176 extends around the periphery of the first chamber 160 and defines an annular bottom shoulder 178 (FIG. 8) which extends inwardly from the periphery of the concave wall means 158. The bottom shoulder 178 is spaced closer to the flow path or the top surface of the block than is the bottom wall portion 162 of the first chamber 160. A sealing gasket or O-ring 180 is supported on the shoulder 178.

The upper block 150 is identical to the lower block 152 and has a first bore 164' and a second bore 168' communicating with first and second chambers 160' and 176', respectively. An O-ring 180' is supported on a shoulder in the first chamber 160'.

With reference now to FIG. 6, it can be seen that the first bores 164 and 164' of the lower and upper blocks, respectively, are connected via conduit or tubing 181 and 182, respectively, to a vacuum source, such as a vacuum motor 184, through a tee connection 183. An adjustable regulating valve 186 may also be provided.

The second bore 168 of lower block 152 is connected through an appropriate conduit or tubing 188 to the vacuum switch 170 and the second bore 168' of the upper block 150 is connected through a conduit or tubing 190 to a vaccum switch 192.

Vacuum switches 170 and 192 are connected in series through electrical conducting paths 194 to a solid state switch 196 so that both switches must be actuated to close (by a change in pressure in tubes 188 and 190) in order to complete the circuit to switch 196.

In operation, the vaccum source or motor 184 is operated to draw vacuum from the first and second chambers in each of the blocks 150 and 152 through the tubes 181 and 182. This is indicated for the lower block 152 in FIG. 8 by the arrows 198 which show the flow of air being drawn through the block 152 from the second bore 168, first chamber 160, and first bore 164. The creation of a vacuum, or more accurately, the creation of a reduced pressure in the tubing 181, the chamber 160, and the tubing 188 can be easily effected only if the communication between the second chamber 176 and the path is blocked. This will happen if a document is brought close enough to the surface of the block over the second chamber 176 so that the flow of ambient air into the second chamber 176 is substantially reduced. Creation of a reduced pressure within the chamber 176 and necessarily, within the communicating first chamber 160 and tubing 188, will cause the vacuum switch 170 to be actuated. Vacuum switch 192 is actuated under an analogous situation with the upper block 150.

Now with reference to FIG. 3, it can be seen that in normal operation, the feeder subassembly 32 feeds one document at a time path the double document detector 96. This is illustrated with document 50" shown disposed between the upper block 150 and the lower block 152 of the double document detector 96. There will be a slight tendency, owing to the continuous drawing of a vacuum by the vacuum pump 184, for the single document 50" to be forced by the ambient air pressure against one or the other of the upper and lower blocks 150 and 152. However, as this occurs, the vaccum is being drawn through tubing 181 and 182 on both blocks simultaneously by means of the vacuum pump 184 connected through tee section 183. Thus, by suitable design of the vaccum system (e.g., vaccum pumping rate, tubing length, and internal tube diameter), the ambient air taken into the vacuum pump 184 will follow the path of least resistance and will enter the tee 183 from whichever block 150 or 152 does not have the second chamber 176 partially covered by the document. Further, air entering the tubing from the uncovered block will tend to equalize with the pressure in the tube to the other block. Thus, a sustained low pressure region cannot exist in only one of the blocks owing to the tee connection 183. Since a sustained low pressure region cannot exist in one of the blocks, the single document will not remain preferentially drawn to either one of the blocks 150 and 152 and will instead pass thereby unhindered.

In contrast, however, two overlapping documents passing along the document feed path will not pass unhindered through the double document detector 96. If the stack feeder 76 improperly feeds two documents at once, the two documents will proceed along the document feed path in completely or partially overlapped formation. As the two overlapped documents pass between the upper block 150 and lower block 152 of the double document detector there will be a slight tendency for one of the documents to be drawn towards the upper block 150 and for the other document to be drawn towards the lower block 152. As this occurs, the flow of ambient air from the document feed path into the blocks is somewhat restricted and reduced. Since the vacuum pump 184 is continuously operating, a low pressure region is created in the tubing 181 and 182 to each of the blocks 150 and 152, respectively.

Since the flow of air into the blocks is restricted by the two documents between the blocks, the pressure in the tubes 181 and 182 is reduced even further. This self-reinforcing process occurs very quickly and continues until each document has come into contact with an adjacent block and fully covered the chambers therein. This is illustrated for the lower block 152 in FIG. 8. One of two documents, 50'', is shown drawn against block 152 and covering the chambers 160 and 176. The face of the document 50'' is in substantially sealing contact with the O-ring 180 and the portion of the document 50'' directly over the chambers 176 and 160 is drawn inwardly towards the bottom wall 162. The substantial sealing off of the chambers by the adjacent document 50'' prevents any substantial inflow of ambient air from the path into the block 152. Consequently, the vacuum pump 184 draws out the air remaining in tube 181 and 188, reducing the pressure therein significantly and actuating swith 170.

The upper block 150 is covered by the other document in the same manner as described above and illustrated in FIG. 8 for document 50''. Consequently, a vacuum is drawn in tube 190 and vacuum switch 192 is also actuated.

When switches 170 and 190 are actuated by the low vacuum, they are both in the electrically closed mode so that the electrical circuit through each switch is completed. Since both switches 170 and 192 are connected in series, the electrical circuit is completed to switch 196 so that switch 196 is necessarily actuated to operate suitable annunciator systems and/or machine shutdown control systems.

Preferably, switch 196 would operate a shut-down system which would function to terminate further operation of the feeder subassembly 32 and which would activate an annunciator to signal an operator that two overlapping documents were being held at the double document detector 96.

Next, a switch, not illustrated, can be operated to actuate a three-way solenoid valve 210 in the vacuum tube 190 connected to the upper block 150 for venting the upper block 150 to atmosphere through solenoid valve orifice 212. Ambient air enters the chambers in block 150 through the valve 210 to equalize pressure in the block with the ambient air pressure. At this point, the document adjacent the upper block 150 will fall away from the block under the influence of gravity. In a typical feeder, such as that illustrated in FIG. 3, the document will also fall forwardly down the slanted path of the endless belt means 90. Since the belts 120 are still running, the document is then positively carried forward along the path. The solenoid valve 210 need only be opened momentarily to vent the system in order to thus release the document from the upper block 150.

After the document has fallen away from the upper block 150, ambient atmosphere from the document feed path enters the block 150 through the chambers therein and passes into the vacuum tubing 182 and begins to equalize the entire vacuum tubing system through tee 183 up to the lower block 152. The flow of ambient air from the path into the upper block 150 brings the pressure within the tubes 181 and 182 up to substantially atmospheric pressure so that the document adjacent block 152 is no longer held thereagainst and is then free to slide down the slanted path between the belts 120 of the conveyor belt means 90.

By appropriate design of the control system, the first gate means can be actuated to open upon release of the first document from the double document detector 96 to allow it to pass therepast and to quickly close in order to block the second of the documents which is subsequently released from the double document detector 96.

In some applications of transporting documents, it is desired that the documents be fed from a stack of documents 70 by the stack feeder 76 and that the order of the feeding of the documents be the same as the order of the documents from front to back in the stack 70.

Usually, the documents are numbered, as by a conventional numbering head 98 cooperating with a printing impression roller 99, when the documents pass through the document feed path. In those situations where two documents are accidentially fed together by the stack feeder 76 and where they are subsequently separated by the above-described operation of the double document detector 96, it is possible that the order of the two documents may be reversed. However, if two documents are accidentially fed at the same time by the stack feeder 76, the first document almost always lies on top of the second document as the two documents proceed along the conveyor belt means 90 to the double document detector 96. Consequently, the first release of the upper document (from the upper block of the double document detector before the release of the lower document from the lower block as described above) will maintain the original sequence of the documents.

In many applications, however, the initial document sequence in the document stack 70 is not important. And, since the numbering is applied downstream of the double document detector 96, it makes no difference which of the two documents is first released from the double document detector 96.

It has been found that the novel double document detector apparatus 96 described herein functions extremely well in sensing and subsequently separating two overlapping documents, and especially documents such as bank checks. Prior art double document detectors function in a similar manner but lack the novel second chambers, such as chambers 176 and 176', as well as the O-rings contained therein. Consequently, prior art double document detectors tend not to establish as tight a seal between the documents and the detector blocks as is effected with the described apparatus 96.

Further, prior art devices having only one first chamber, such as chambers 160 and 160', were susceptible to being blocked midway between the first and second bores by the document as it is pulled inwardly by the vacuum (the inward pulling of the document being best illustrated in FIG. 8). Specifically, in prior art devices, the document would be forced inwardly against the bottom wall, similar to bottom wall 162, between the first and second bores. This would prevent vacuum from being drawn through the bores to the vacuum switch. Instead, the vacuum would hold the document in that position and there would be an inleakage of ambient air from the path (past the "bent" document) through the chamber and second bore to the vacuum switch. The vacuum switch would thus be under ambient atmospheric pressure and would not be actuated.

In contrast, the novel two reservoir structure of apparatus 96 effectively seals the block interior from the ambient air but also prevents the document from blocking communication between the first and second bores.

Copy Paper Length Sensor

Hard paper copies are made in the copier subassembly 34 as schematically illustrated in FIG. 2 and as previously described above. The paper on which the copies are made, shown as sheets 70 in FIG. 2, may be provided from long rolls of a continuous strip of paper which is subsequently severed, preferably before the image is fixed thereon, to create an individual sheet of paper having a length equivalent to the copied image. The continuous strip of paper from each roll can be fed through the copier subassembly 34 by means of a plurality of conveyor drive belts in cooperation with a vacuum platen hold down system of the two which is well-known in the art. One such system is shown in FIGS. 3 and 7 of the U.S. Pat. No. 3,728,020 and attention is directed thereto for the description of such a system.

The paper rolls may be severed before or after the image is projected upon the paper. In one well-known system, the rolls of paper are severed into appropriate lengths before the image is projected thereon. The individual sheets are subsequently processed and discharged from the copier. Such a system is illustrated in FIGS. 3 and 7 of the above-discussed U.S. Pat. No. 3,728,020 and reference is directed thereto.

It is also possible to sever the strip of paper after the image has been projected thereon, either before chemical processing or afterwards. In any case, it is necessary to accurately determine the length of each individual sheet that carries, or will carry, the projected image, and to sever that length of sheet from the roll. To this end, a novel copy paper length sensing method and apparatus is provided as illustrated in FIG. 9 and 10.

Figure 9:
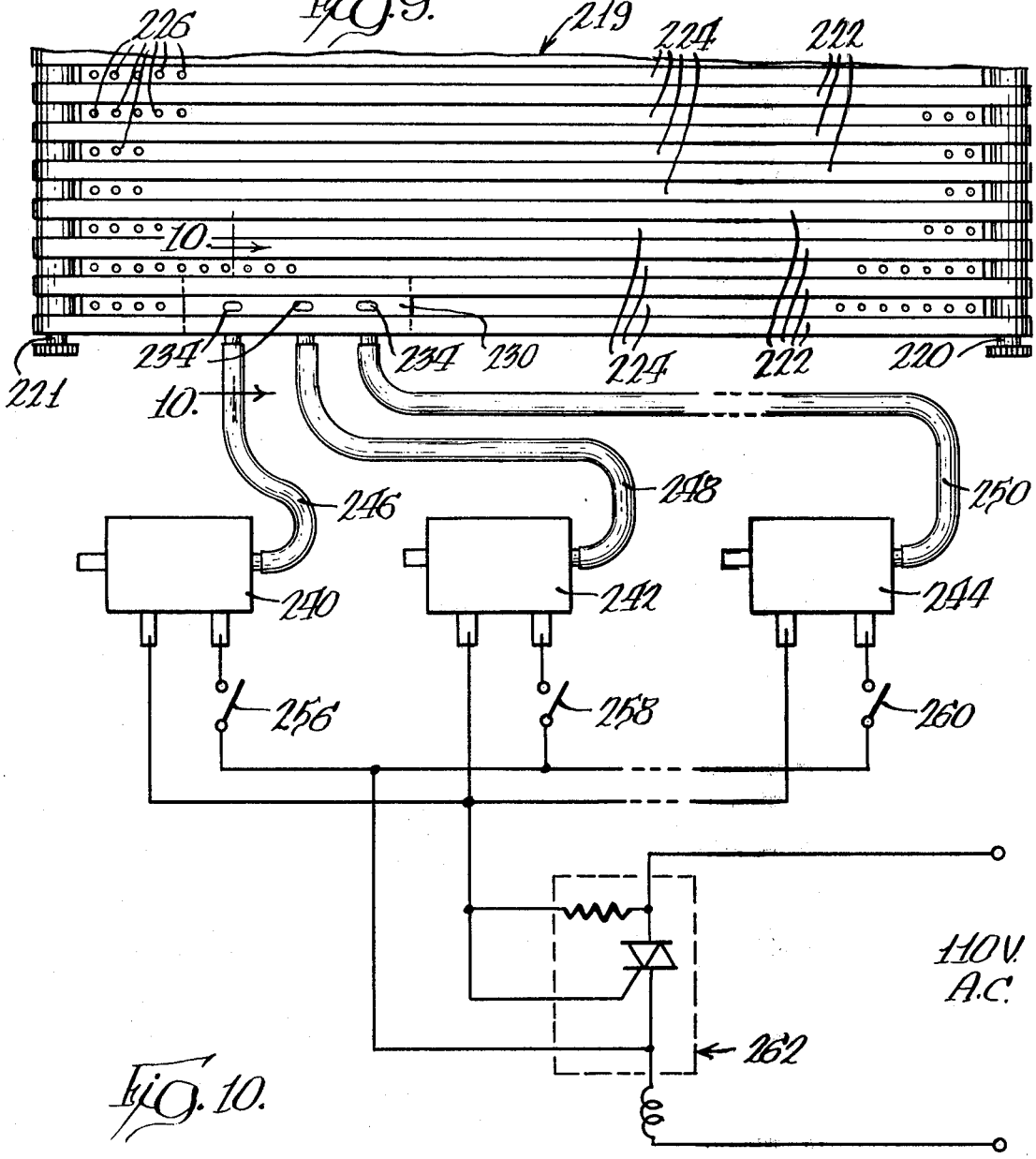
FIG. 9 is a partial diagrammatic view of the copy length sensor subassembly at the discharge of the copier subassembly.

FIG. 9 shows the conventional copy document feed roller system 219 comprising a plurality of driven, flexible, endless traveling belts 222 entrained around rollers 220 and 221 passing along the surface of a copy paper platen 224 provided with a large number of apertures or orifices 226 therein and connected to a copy paper vacuum pump (not shown). The copy paper is retained against the traveling endless belts 222 adjacent to the surface of the copy paper platen 224 by vacuum drawn through the platen apertures or orifices 226. As best illustrated in FIG. 10, the belts 222 rest upon, and are supported by, the platen 224. The surface of the platen 224 is thus somewhat below the outer surfaces of the belts 222. Vacuum is maintained within a vacuum chamber 228 within the platen 224.

In order to sever the roll of paper to provide individual sheets of a predetermined length, it is necessary to sense the length of paper being transported across the platen 224 in relation to the fixed severing means or blade (not shown). To this end, a novel vacuum paper length sensing apparatus is provided within the platen 224. Specifically, the platen 224 is provided with a wall portion 230 of increased thickness which presents a material bearing surface 232 in substantial alignment with, and at the same elevation as, the material transporting surface of the conveyor belts 222. The thick wall portion 230 further defines therein at least one primary sensing bore, such as bores 234 communicating between the ambient atmosphere in the copy paper transport path and the interior of the vacuum chamber 228.

Figure 10:
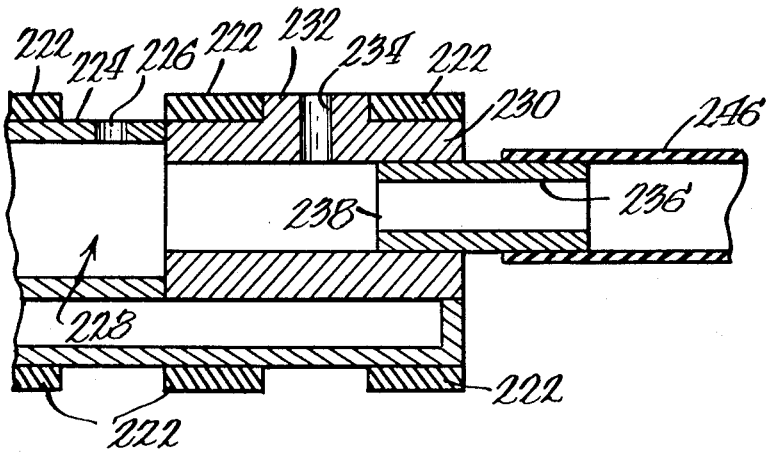
FIG. 10 is a cross-sectional view taken generally along the plane 10—10 in FIG. 9.

As best illustrated in FIG. 10, a secondary sensing bore 236 is associated with each primary sensing bore and each secondary sensing bore 236 has an inlet orifice 238 adjacent the primary sensing bore 234 in the thick wall portion 230, which orifice 238 is located substantially on or near a plane passing through the primary sensing bore 234 transversely of the transport path.

A pressure switch, such as pressure switches 240, 242, and 244 are connected to the secondary sensing bores 236 by means of tubes 246, 248, and 250, respectively.

In operation, a vacuum is continuously drawn in the vacuum chamber 228 of the platen 224 and the vacuum necessarily extends, by virtue of the communication through bores 236 and tubes 246, 248, and 250, to the vacuum switches 240, 242, and 244, respectively.

When there is no copy paper covering the platen 224, ambient air flows into the vacuum chamber 228 through the platen orifices or apertures 226 and also through the primary sensing bores 234. In this situation, when there is no copy paper overlying the platen 224, the degree of vacuum (i.e., absolute pressure) within the tubes 246, 248, and 250 will reach a steady state level. The vacuum switches 240, 242, and 244 are set to be actuated if the vacuum increases (i.e., absolute pressure decreases) beyond this steady state level.

When the length of paper from the roll is fed forwardly (from left to right in FIG. 9) along the platen by the conveyor belts 222, the leading edge of the paper will eventually reach and overlie one of the first of the primary sensing bores 234. When this happens, as can be seen with reference to FIG. 10, the inflow of air through the primary sensing bore 234 will be substantially reduced, if not altogether blocked, and the absolute pressure within that region of the vacuum chamber 228 around the primary sensing bore 234 will be reduced. This reduction in pressure will be sensed by the vacuum switch 240, via communication between the secondary sensing bore 236 and the connecting tube 246. Thus, the actuation of the limit switch 240 will indicate that the leading edge of the paper has advanced to the first primary sensing bore 234 which is associated with that limit switch.

One way of providing a capability for processing a number of different lengths of copy paper sheets is illustrated in FIG. 9 wherein a plurality of vacuum switches, 240, 242, and 244, are connected to a plurality of primary sensing bores 234, which primary sensing bores 234 lie in a line parallel to the direction of travel of the paper and hence, in a line along the length dimension of the paper as it is being fed along the platen. Before the machine is operated, the particular length of the individual sheet of copy paper desired (from three possible lengths) is determined. The primary sensing bore 234 and associated connected vacuum switch corresponding to this length is chosen.

The chosen vacuum switch is electrically connected to the control system by means of a selector switch, such as selector switches 256, 258, and 260 for vacuum switches 240, 242, and 244, respectively. The subsequent actuation of the selected pressure switch (by the reduction in pressure when the paper passes over the associated primary sensing bore) completes the electrical circuit enabling a solid state switching device, such as device 262, to energize an appropriate paper length severing mechanism (not shown). The feeding of the paper from the roll is preferably temporarily interrupted or stopped for an instant while the roll is severed. The severed piece of paper continues forward on the platen until the trailing edge of the paper passes the primary sensing bore, thereby permitting an inflow of ambient air to raise the absolute pressure at the selected pressure switch and open the pressure switch electrical contacts.

Although FIG. 9 illustrates a copy paper length sensor mechanism having three primary sensing bores and three associated vacuum switches, any number of sensing bores and vacuum switches may be used, depending upon the number of different lengths of sheets of copy paper it is desired to produce.

It is to be understood that if two rolls of copy paper are provided side by side in parallel paths as schematically illustrated in FIG. 2, only one line of primary sensing bores need be provided for one of the two rolls. However, if slippage during feeding of the paper across the platen is deemed to be a problem with the particular platen drive system used, it may be desirable to provide two separate platen drive systems and length sensing means, one such system for each roll of paper.

Copy Document Collator/Stacker: First Embodiment

An apparatus or subassembly for collating and stacking documents will next be described. The subassembly is described in use and in conjunction with an automatic copier machine, and specifically, with respect to collating and stacking paper copies made from original documents in the copier machine. It is to be understood however, that the collator/stacker subassembly can be used on many types of web-type articles, including but not limited to, documents that are copies and documents that are originals.

After the images have been developed on the copy paper and after the individual severed copies are discharged from the copier subassembly 34, it is desirable to collect the copies in a single stack and in an order corresponding to the initial machine in-feeding order. Specifically, with two or more parallel paths of copies being produced from groups of two or more documents fed sequentially from a single stack, it is necessary to assemble the copies from each parallel path in an order that corresponds to the stack of original documents. Accordingly, a novel method and apparatus for sorting and assembling copies in a single stack is provided. Such a collator/stacker subassembly 36 is adapted to cooperate with the discharge of a copier subassembly 34 as illustrated in FIG. 1.

Figure 11:
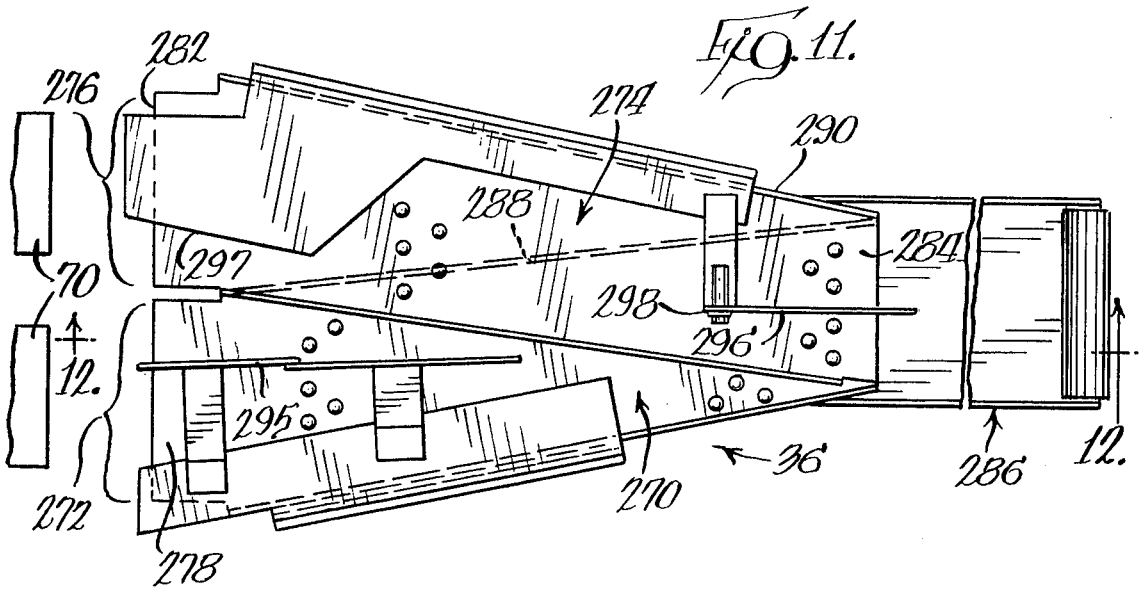
FIG. 11 is a plan view of the first embodiment of the collator/stacker photocopy document subassembly which is located at the discharge of the copier subassembly of the apparatus.
Figure 12:
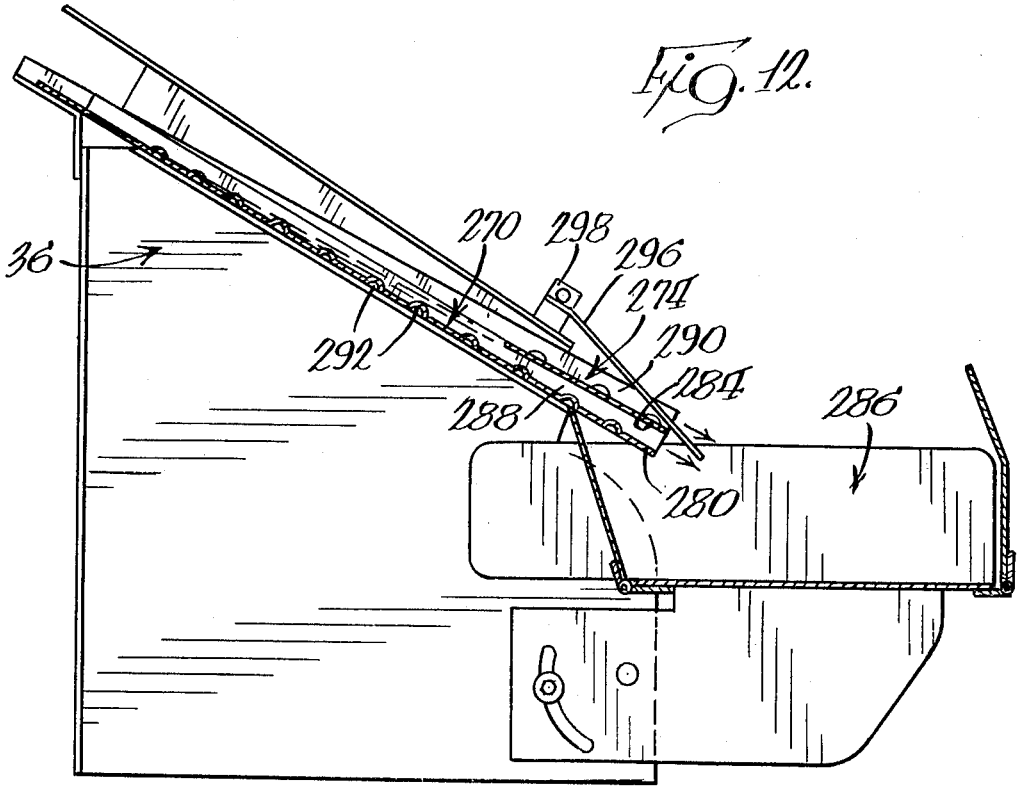
FIG. 12 is a cross-sectional view taken along the plane 12—12 in FIG. 11.

The first embodiment of the collator/stacker subassembly 36 is shown in greater detail in FIGS. 11 and 12. The apparatus 36 is designed to receive copy documents from first and second adjacent, parallel transport paths 272 and 276, respectively. Preferably, the apparatus 36 receives the copy paper documents 70 illustrated in FIG. 2, which copy documents 70 are aligned in rows of two documents transverse to the paths. The collator/stacker subassembly 36 is adapted to arrange the documents from the two paths into a single stack of documents wherein the two documents of each row in the transport paths are stacked one on top of the other so that the document from one path in a given row is below the adjacent document from the other path of the same row.

The collator/stacker subassembly 36 comprises a first discharge slide 270 slanting generally downwardly from the end of the first transport 272 and a second discharge slide 274 slanting generally downwardly from the end of the second transport path 276.

The first discharge slide 270 has an upper receiving end 278 and a lower discharge end 280. The second discharge slide 274 also has an upper receiving end 282 and a lower discharge end 284. The lower discharge end 284 of the second discharge slide 274 is generally aligned over the lower discharge end 280 of the first discharge slide 270.

A receiving box 286 is disposed beneath the vertically aligned discharge ends 280 and 284 of the first and second slides 270 and 274, respectively, and has an opening for receiving documents sliding off of the first and second slides which form a stacked array of the documents in the box.

To prevent the copy documents from sliding off of the sides of the slides, and to guide the documents into the box 286, it is desirable to provide vertical side flanges, such as flanges 288 and 290, on the first and second slides 270 and 274, respectively.

To reduce the tendency of the copied documents to stick to, or cling to, the slides, the bottom of each slide is preferably formed with an array of convex protrusions 292.

The first discharge slide 270 has an overhanging member 295 and the second discharge slide 274 has an overhanging bar 297. These structures function to prevent the documents from lifting off of the slides.

As can be seen in FIGS. 11 and 12, a document 70 exiting from a first path 272 of one of two parallel paths enters the first slide 270 through the receiving end 278 and is directed along a first discharge path on the first slide 270 for a given period of time until it gets to the bottom of the first slide 270 at the discharge end 280. From there the document falls into the receiving box 286.

Simultaneously with the document from the first path entering the first slide, another document from the copier subassembly 34 enters the second slide 274 from the second transport path 276 at the receiving end 282 and is directed along the second slide 274 to the box 286, but enters the box above, or on top of, the first document.

Though not necessary, the second document may be kept on the second slide 274 for a period of time which is longer than the period of time required for the first document to slide down the first slide 270. The period of time during which the second document slides down the second slide 274 can be adjusted by changing the length of travel of the document, as by angling the end 282 of the second slide 274 away from the receiving box 286 while providing a generally straight line run for the first slide 270 to the receiving box 286.

Additionally, though not necessary, the rate of movement of the second document on the second slide 270 can be reduced by the use of a document inhibiting member such as a wire 296 pivotally supported above the second slide 274 on bracket 298. When the second document slides down the second slide 274, it impinges against the wire 296. As the wire 296 pivots upwardly under the force of the sliding document, the speed of the document is reduced owing to the momentum transfer and owing to the subsequent friction force of the wire 296 against the document sliding past it. The wire 296 may also function to direct the leading end of the document into the box.

In any case, the document sliding down the second slide 274 arrives in the receiving box 286 on top of the document which has slid down the first slide 270. Consequently, the document from the first path 272 always enters the receiving box 286 beneath the document from the second path 276 and is always stacked below the document from the adjacent path 276.

Copy Document Collator/Stacker: Second Embodiment

A second embodiment of a collator/stacker is illustrated in FIGS. 13 through 16 and is generally designated 310 therein. The second embodiment of the subassembly 310 is adapted to be mounted to any device which discharges two parallel rows of documents, such as the copier subassembly 34 illustrated in FIG. 1. The second embodiment of the collator/stacker 310 would replace the first embodiment 36 illustrated on the side of the copier subassembly 34 in FIG. 1.

The second embodiment of the collator/stacker 310 has a receiver means 312 adapted to be aligned at the end and below a first of two parallel transport paths for receiving documents as the documents are discharged from the first transport path. The receiving means 312 preferably comprises a back wall 314, a front wall 316, two opposed sidewalls 318 and 320, and a bottom 322. Preferably an elongated slot divides portions of the front wall and bottom into spaced apart sections to allow the insertion of an operator's fingers for removing the contents of the receiver means 312.

A document holding platform 324 is provided adjacent the receiving means 312 and is adapted to be positioned at the end of, and in alignment with, a second document transport path parallel to the first transport path. The documents from the second transport path are discharged onto the holding platform 324.

In operation, two parallel rows of documents are fed into the collator/stacker 310, by means to be described in detail hereinafter, with a document of the first row of the first path being directed into the receiver means 312 and with a document from the first row of the second path discharged onto the document holding platform 324. Before another document is discharged from the first document path into the receiver means 312, the document on the holding platform 324 is moved, by a mechanism to be described hereinafter in more detail, into the receiver means 312 on top of the first document already contained therein. The specific mechanisms for feeding the documents into the receiver means 312 and onto platform 324, as well as the specific means for moving the documents from the platform 324 to the receiver means 312, will now be explained in detail.

Figure 16:
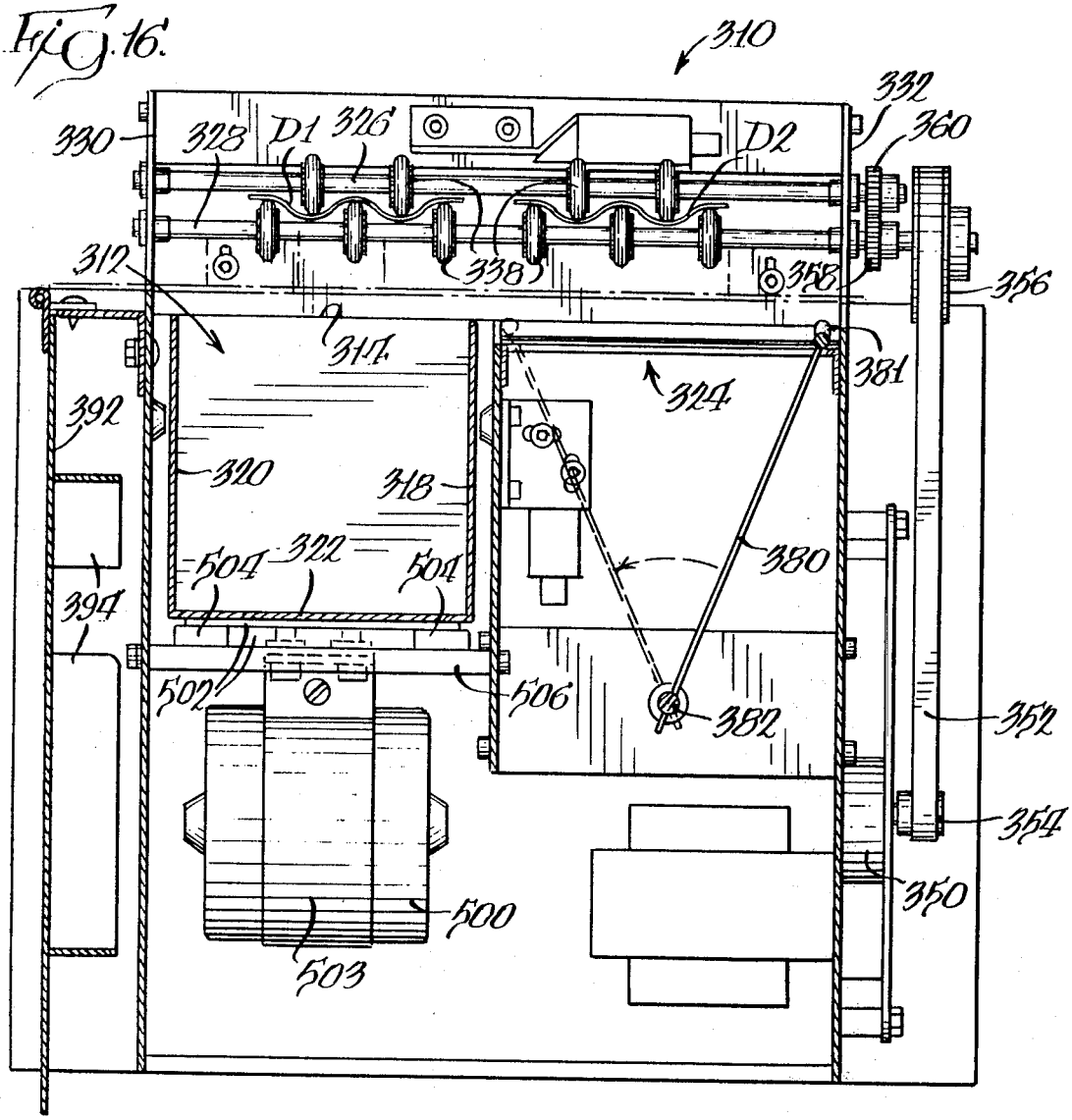
FIG. 16 is a cross-sectional view taken along the plane 16—16 of FIG. 14.

The documents exiting from the copier subassembly 34 are received between a pair of rollers, upper roller 326 and lower roller 328, which are mounted for rotation in sidewalls 330 and 332 as best illustrated in FIG. 16. The document D1 from the first path is shown on the left-hand side of the collator/stacker 310 between rollers 328 and 326 above the receiver means 312. A second document D2 from the second path, and in the same row as document D1 in the first path, is shown on the right-hand side of the collator/stacker 310 between rollers 326 and 328 above the holding platform 324.

It is to be noted that both of the documents D1 and D2 have slight corrugations, that is, the lateral edges of the documents that are parallel to the document transport paths are at a slightly higher elevations than inner portions of the documents. This is created by the circumferential protrusions 338 and cooperating lesser diameter of the rollers. The corrugated configuration thus formed in the documents D1 and D2 as they pass through the rollers 326 and 328 provides an increased rigidity, temporarily, as they discharge from the rollers.

Preferably, the rollers 326 and 328 are rotated so that the speed of the surface of the protrusions 338 is slightly greater than the speed of the documents being conveyed from the copier subassembly 34. This causes a slight amount of frictional-induced pulling of the document from the copier subassembly 34.

Figure 14:
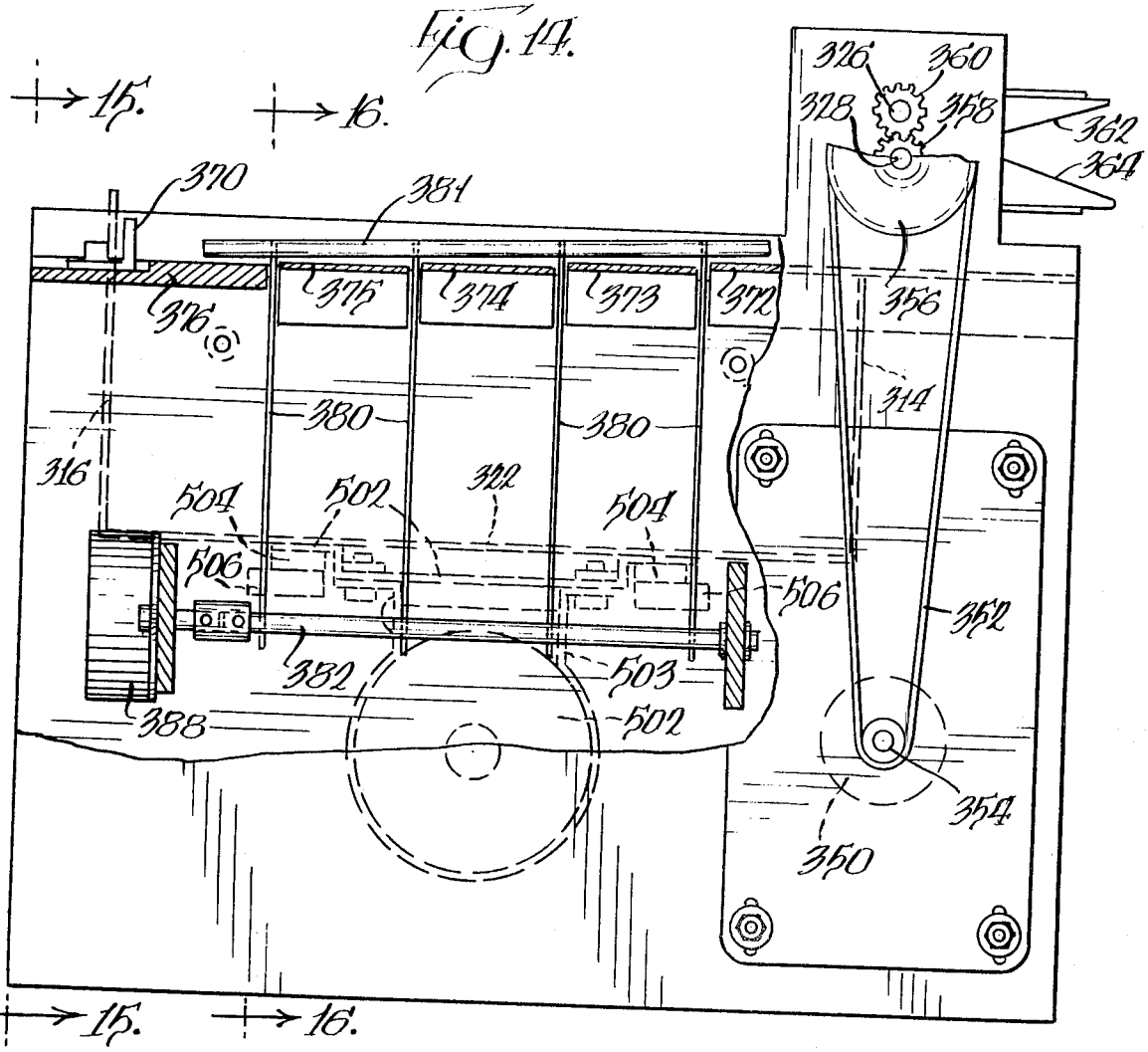
FIG. 14 is a side elevational view, partly in section, showing the various components of the second embodiment of the photocopy collator/stacker subassembly of the apparatus.

The rollers are preferably driven by a suitable drive means such as motor 350, illustrated in FIGS. 14 and 16, acting through a drive belt 352 trained around wheels 354 and 356. Wheel 354 is connected to the motor 350 and wheel 356 is connected to lower roller 328. Lower roller 328 has a drive gear 358 near one end for engaging a driven gear 360 mounted on the end of upper roller 326. Upper roller 326 is thus rotated in the opposite direction from lower roller 328.

Preferably, a pair of angled guide plates 362 and 364 are provided on the back of the collator/stacker 310, as illustrated in FIG. 14, for being inserted into a suitable receiving aperture at the discharge region of the copier subassembly 34. The angled guide plates 362 and 364 serve to direct and guide the leading or front edges of the documents from the copier subassembly 34 between the lower roller 328 and upper roller 326 of the collator/stacker subassembly 310.

Figure 13:
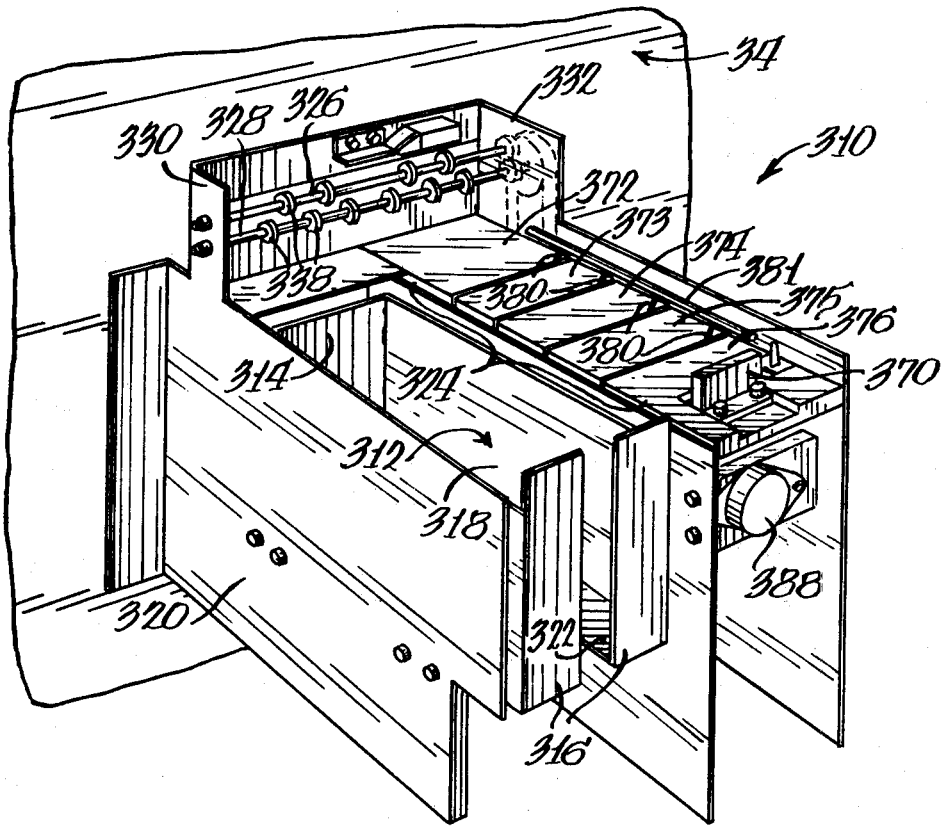
FIG. 13 is a perspective view of the second embodiment of the photocopy document collator/stacker subassembly which is located at the discharge end of the copying portion of the apparatus.

When a document, such as a copy D2 produced by the copier subassembly 34, is fed into the collator/stacker subassembly 310 in the right-hand path (as viewed in FIG. 16) the document passes between the upper roller 326 and the lower roller 328 above the document holding platform 324 and then falls onto the platform 324. Any tendency of the document to overshoot the platform is prevented by a stop member 370 at the far end of the platform 324 (FIG. 13).

The platform 324 is comprised of a plurality of support elements 372 through 376 placed in end-to-end array. Each support element is spaced apart from the adjacent support elements at each end to define spaces or channels therebetween for reasons to be explained hereafter. The support elements are staggered in elevation with the elevation of successive support elements decreasing with increasing distance from the end of the transport paths (the end of the transport paths being generally defined at the upper and lower rollers 326 and 328, respectively). Specifically, with reference to FIG. 14, it can be seen that the first support element 372 below the rollers 326 and 328 is at a higher elevation than the adjacent support element 373. The remaining support elements, 374 through 376, are also successively stepped downwardly. The stepped construction of the support platform 324 forms a broken document support surface which, though interrupted by the channels between each separate support element, allows the leading end of each document to slide along the entire length of the platform without becoming stuck in one of the channels. Preferably, the difference in elevation between each adjacent support element is about 0.05 inch.

The platform 324 may be a single block of material with slots machined in the block and with the individual support elements being machined surfaces in the block.

After a document has been fed onto the support platform 324, it is next moved (from the right to the left as viewed in FIG. 13) by projecting finger members 380. The finger members 380 are moved between the individual support elements to engage the side edge of the document lying on the platform and to force the document sideways (transverse to the document transport path) into the receiver means 312 as best illustrated in FIG. 15 for document D1.

Preferably the fingers 380 are connected at their distal ends by a rod 381. This provides a slightly overhanging projection for engaging the edge of a document and prevent the document from riding over the fingers.

The fingers 380 are mounted on, and project from, a shaft 382 connected to a suitable actuating means, such as a stepping motor 388. Instead of a stepping motor, a full rotation direct current motor or a rotary solenoid could be used with an appropriate transmission system to provide the oscillatory movement of the fingers 380 through the necessary angle of rotation.

Figure 15:
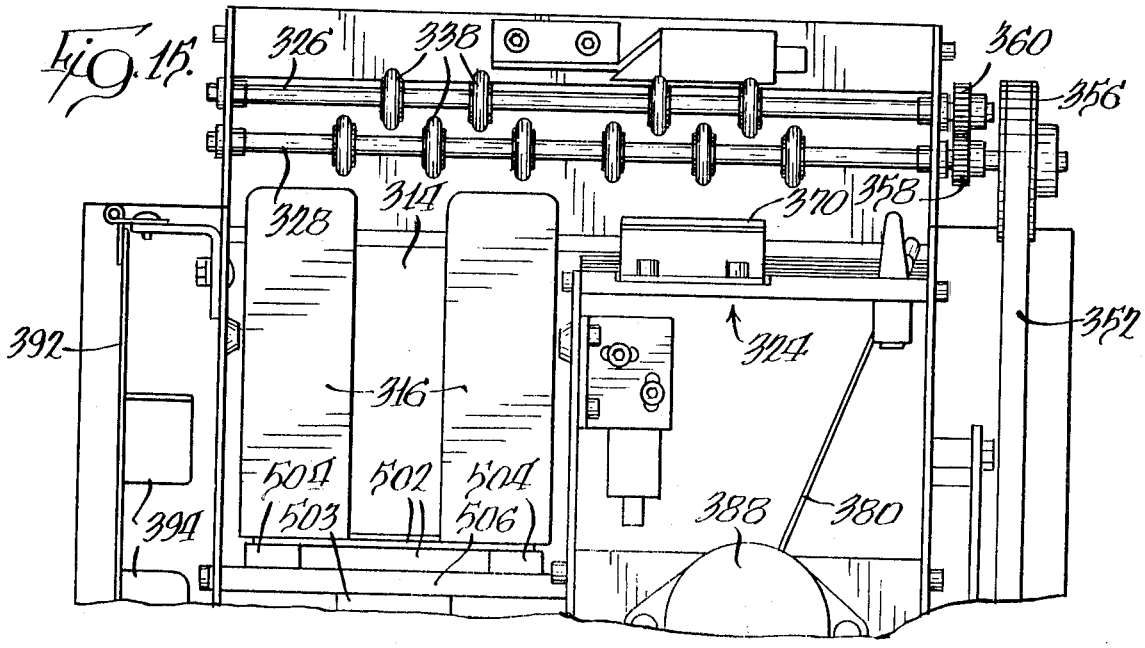
FIG. 15 is a fragmentary end view taken along the plane 15—15 of FIG. 14.

As shown in FIGS. 15 and 16, the collator/stacker 310 can be provided with a hinged plate 392 along the left-hand side of the collator/stacker 310. (The plate is not shown on the collator/stacker 310 in FIG. 13). The plate 392 has walls 394 forming a document collecting bin and can be swung upwardly (in a clockwise direction as viewed in FIG. 16) so that it overlies the receiving means 312 and is supported by platform 324. In that orientation, the bin forms a single receiver means in which oversized documents can be fed to form a single stack of such oversized documents. When such oversized documents are fed to the collator/stacker, only one transport path of such documents can be necessarily accommodated by the collator/stacker.

Figure 17:
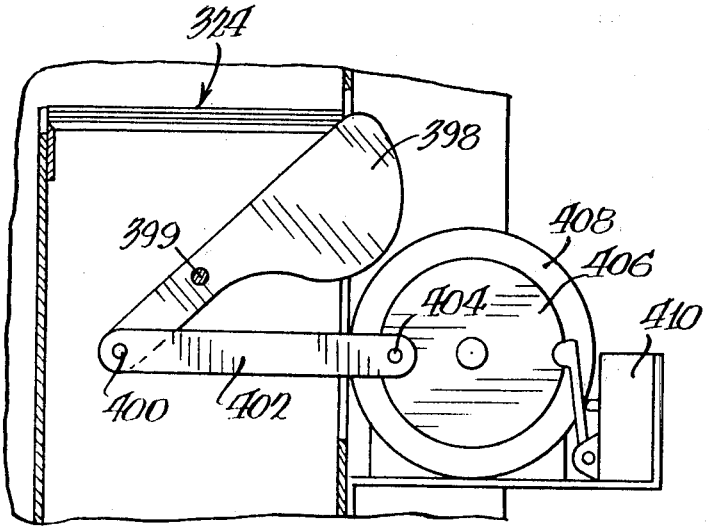
FIG. 17 is a fragmentary cross-sectional view of an alternate embodiment of the copy document lateral shifter portion of the second embodiment of the collator/stacker subassembly.

FIG. 17 shows an alternate embodiment of the finger means which are used to push the documents from the support platform into a receiver means. Specifically, instead of using wire-like fingers 380 as illustrated in FIGS. 13 through 16, flat plates 398 are provided. Each plate 398 is pivotably mounted about a fixed pin 399 and is connected on the distal end through a movable pivot pin 400 to drive link 402 which in turn is pivotally connected through pin 404 to a rotating drive wheel 406 driven by a suitable means, such as motor 408. A limit switch 410 may be provided for actuation by the drive link 402 and which, in cooperation with suitable conventional control means, would control the operation of the motor 408 to intermittently oscillate the finger plates 398 to push a document off of the support platform 324 and then return the plates 398 to the position illustrated in FIG. 17 so that the next document can be fed onto the support platform 324.

It has been found that the novel second embodiment of the collator/stacker subassembly 310 is especially reliable when handling paper copies that have a slight curl along the edges or corners. Curling of paper is more frequently found in "old" paper that has been stored for long periods and such curled paper tends not to slide as well over surfaces as does uncurled paper. With the second embodiment of the collator/stacker subassembly 310, such curled paper is not a problem since there is a direct feed of documents from one transport path into the receiver means 312 and since there is a positive movement of the paper from the other transport path into the receiver means 312 by fingers 380 or finger plates 398.

Depending upon atmospheric conditions and upon the physical characteristics of the copy paper documents being stacked by the collator/stacker subassembly 310, problems can arise in forming a well-compacted stack of documents in the receiver means 312. Sometimes when a document is moved from the support platform 324 by the projecting finger members 380 into the opening of the receiver means 312, the document will not fall into the receiver means 312 in a flat orientation. The document may become skewed or angled in the receiver means 312 and may lean against one of the two opposed sidewalls 318 and 320.

It has been found that problems of this sort can be eliminated by securing a vibrator device to the receiver means 312. Specifically, with reference to FIGS. 14, 15, and 16, a motor-vibrator 500 is bolted to a hat-shaped intermediate support member 502 with clamp 503. The clamp 503 is held against the underside of the receiver means 312 by rubber bumpers 504. The bumpers 504 are supported by cross bars 506 to retain the whole assembly (the motor-vibrator 500, clamp 503, and member 502) against the bottom of the receiver means 312 so that the vibration can be transmitted to the receiver means 312.

It has been found that a motor-vibrator of the type made by Dayton Electric Manufacturing Company, Part No. 3M564, produces satisfactory results when used with a receiver means 312 of the size and type described herein. Obviously, the method of mounting the motor-vibrator to the receiver means 312 and the size the motor-vibrator will depend upon, among other things, the materials used for construction of the receiver means 312, the structural sizes of the components involved, and the means by which the components are secured together.

The use of the vibrator device with the receiver means adds a certain amount of "forgivability" to the operation of the collator/stacker. Its use has been found to (1) align documents from a skewed plane to a horizontal plane with respect to the bottom of the receiver, (2) flatten out the documents within the receiver means, (3) prevent curling of the documents in the stack, and (4) cause the stack of documents to build up in a tighter, more dense stack.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

What is claimed is:

1. An apparatus for receiving documents from first and second adjacent, parallel transport paths in which the documents are aligned in rows of two documents transverse to the paths, said apparatus adapted to arrange the documents into a single stack of documents wherein the two documents of each row in the transport paths are stacked one on top of another such that the document from the first path in a selected row is below the adjacent document from the second path of said selected row, said apparatus comprising:

a stationary, final document receiving means adapted to be aligned at the end of and below said first transport path for receiving documents as the documents are discharged from said first transport path;

a single document holding platform adjacent said receiving means and adapted to be positioned at the end of and in alignment with said second transport path, said platform adapted to receive a document discharged from second transport path, said platform defining a plurality of channels within said platform, said platform comprising a plurality of support elements placed in an end-to-end array, each said support element having a substantially horizontal support surface and being spaced apart from adjacent support elements at each end to define one of said channels at each end, said support elements being successively staggered in elevation with the elevation of successive support elements decreasing with increasing distance from the end of said second transport path; and means for engaging and moving said documents transversely of said second transport path comprising a plurality of finger elements, each finger element being partially disposed within and partially projecting from one of said channels, each finger element being adapted to move across the width of said platform transversely of said second transport path to engage one edge of a document lying on said platform and to move said document off of said platform and into said receiving means.

2. The apparatus in accordance with claim 1 in which the difference in elevation between successive adjacent elements is 0.05 inch.

* * * * *

UNITED STATES PATENT OFFICE

CERTIFICATE OF CORRECTION

Patent No. 4,269,401 Dated May 26, 1981

Inventor(s) John R. Sargis

It is certified that error appears in the above-identified patent and that said Letters Patent are hereby corrected as shown below:

Column 4, line 41, "arraging" should be --arranging--.

Column 5, line 58, "an" should be --as--.

Column 6, line 8, "a" should be --in--.

Column 8, line 44, insert --gate-- after "such".

Column 9, line 11, "opening" should be --opening--.

Column 12, line 46, "path" should be --past--.

Column 15, line 29, "two" should be --type--.

Signed and Sealed this

First Day of September 1981

[SEAL]

Attest:

GERALD J. MOSSINGHOFF

Attesting Officer

Commissioner of Patents and Trademarks

UNITED STATES PATENT OFFICE

CERTIFICATE OF CORRECTION

Patent No. 4,269,401 Dated May 26, 1981

Inventor(s) John R. Sargis

It is certified that error appears in the above-identified patent and that said Letters Patent are hereby corrected as shown below:

Column 1, line 60, "sequentai" should be --sequential--.

Signed and Sealed this

Tenth Day of November 1981

[SEAL]

*Attest:*

GERALD J. MOSSINGHOFF

*Attesting Officer*

*Commissioner of Patents and Trademarks*